US006079988A

United States Patent [19]

Hashiguchi et al.

[11] Patent Number: 6,079,988

[45] Date of Patent: Jun. 27, 2000

[54] ELECTRICAL CONNECTOR HAVING SPRING CONTACT WITH DOUBLE CONTACT PROJECTIONS AS A CONTACT REGION WITH CONTACT PAD OF AN EXTERNAL ELECTRONIC COMPONENT

[75] Inventors: Osamu Hashiguchi, Akishima; Takuya Takahashi, Yamanashi, both of Japan

[73] Assignee: Japan Aviation Electronics Industry, Limited

[21] Appl. No.: 09/290,590

[22] Filed: Apr. 13, 1999

[30] Foreign Application Priority Data

Apr. 17, 1998 [JP] Japan ..... 10-107820

[51] Int. Cl.[7] ..... H01R 4/58

[52] U.S. Cl. ..... 439/66; 439/81; 439/862

[58] Field of Search ..... 439/66, 81, 862

[56] References Cited

U.S. PATENT DOCUMENTS 4,553,192 11/1985 Babuka et al. ..... 439/66 X 5,632,631 5/1997 Fjelstad et al. ..... 439/66 X

FOREIGN PATENT DOCUMENTS 9-73960 3/1997 Japan .

*Primary Examiner*—Stanley J. Witkows

*Attorney, Agent, or Firm*—Laff, Whitesel & Saret, Ltd.; J. Warren Whitesel

[57] ABSTRACT

A spring contact 10 has a pair of round contact projections 11 and 12 symmetrically formed at both sides of a peak of a bending top thereof. The spring contact is fixed to an insulator 20 at a central portion thereof and has a second contact region 13 at a lower end thereof. The spring contact is located in a natural condition where no external force is applied. In this condition, the round contact projection 11 is located at a position remotest from the surface of the insulator. When an electronic part approaches perpendicularly to the surface of the insulator, a contact pad of the electronic part at first touches one of the round contact projections 11 and finally touches the other of the round contact projections 12 after the spring contact is deformed and displaced to a deformed position. At this time, the wiping displacement d of the spring contact in the direction perpendicular to the connecting direction of this connector is extremely small.

6 Claims, 7 Drawing Sheets

ELECTRICAL CONNECTOR HAVING SPRING CONTACT WITH DOUBLE CONTACT PROJECTIONS AS A CONTACT REGION WITH CONTACT PAD OF AN EXTERNAL ELECTRONIC COMPONENT

BACKGROUND OF THE INVENTION

This invention relates to an electrical connector having at least an elastically deformable spring contact and, in particular, to an electrical connector which is interposed between a printed circuit board and an electronic part and which electrically connects the printed circuit board and the electronic part by applying compressive force from the outside. Since the electronic part referred to in the specification includes the printed circuit board, this invention is also directed to a connector which electrically connects two printed circuit boards.

Referring to FIGS. 1, 2, and 3A to 3D, three existing connectors will be described hereafter.

At the outset, a first existing electrical connector will be described referring to FIG. 1.

In FIG. 1, a spring contact 10 is fixed to an insulator 20 at a central portion thereof. The spring contact 10 has a round contact projection 18 at a bending top and a second contact region 19 at a lower end thereof, respectively. The spring contact 10 is located at an initial position depicted by a solid line in a natural condition where no external force is applied. In this condition, the round contact projection 18 is located at a position remotest from the surface of the insulator 20, that is, a position on a two-dot chain line extending in parallel to the surface of the insulator 20.

When an electronic part (not shown) is made to approach the surface of the insulator 20 in a connecting direction perpendicular thereto, the contact pad of the electronic part touches the round contact projection 18. As a result, the spring contact 10 is elastically deformed to move from the initial position to a deformed position depicted by a two-dot chain line.

Following the movement of the spring contact 10 from the initial position (solid line) to the deformed position (two-dot chain line), the round contact projection 18 slides on the lower surface of the electronic part over a certain distance. In other words, the lower surface of the electronic part is wiped by the round contact projection over the certain distance. Such distance is represented by D1 in the figure and will be referred to as a wiping amount of the spring contact 10.

Next referring to FIG. 2, a second existing electrical connector will be described.

The second existing electrical connector is similar to the first existing electrical connector except that the radius of curvature of the bending top of the spring contact 10 is greater than that of the first existing electrical connector.

With this structure, the round contact projection 18 is brought into contact with the contact pad of the electronic part over a wide area as compared with the first existing electrical connector. Therefore, the spring contact 10 of the second existing electrical connector has a wiping amount D2 smaller than the wiping amount D1 of that of the first existing electrical connector. It is noted here that, in case where the contact force between the contact pad of the electronic part and the round contact projection 18 of the spring contact 10 in the second existing electrical connector is equal to that in the first existing electrical connector, the contact force per unit area of a contact portion is weaker in the second existing electrical connector than in the first existing electrical connector.

Turning to FIGS. 3A to 3D, a third existing electrical connector will be described. This connector is described in Japanese Unexamined Patent Publication (JP-A) No. 73960/1997.

Each of a plurality of U-shaped spring contacts 220 comprises a metallic plate which is formed into a generally U shape by punching and bending. The U-shaped spring contact 220 has a round contact projection 221 formed at its bending top. The U-shaped spring contact 220 has at its one end a slightly curved portion toward the inside of the U shape, with a second contact region 222 formed at the slightly curved portion. The U-shaped spring contact 220 has the other end 223 wider than the remaining portion of the U-shaped spring contact 220 so that the U-shaped spring contact 220 is prevented from slipping out or disengaged from a corresponding one of a plurality of contact receiving holes 211 formed in the insulator 20. Between the bending top and the second contact region 222, the U-shaped spring contact 220 is provided with a first bending portion 224 bent outwards of the U shape and a second bending portion 225 bent towards the inside of the U shape. Further, the U-shaped spring contact 220 has, between the bending top and the other end 223, a third bending portion 226 bent towards the inside of the U shape.

As shown in FIG. 3B, the plurality of contact receiving holes 211 are separated from each other by a plurality of partition walls 212 each of which is shorter than the plate thickness of the insulator 20 provided with the contact receiving holes 211. Therefore, a clearance 213 is formed between the lower end of each of the partition walls 212 and the upper surface of a printed circuit board 90. Each of the contact receiving holes 211 is a through-hole formed in the insulator 20 into which the U-shaped spring contact 220 is inserted. The contact receiving hole 211 has a rectangular section and extends generally perpendicular to the surface of the insulator 20. The contact receiving hole 211 has an upper portion widened toward its upper end so that the width A at the upper end is greater than the width B of a lower portion.

Referring to FIG. 3A, a gap between two opposite legs of each of the U-shaped spring contacts 220 is greatest at a gap C between the second bending portion 225 and the other end 223. The U-shaped spring contact 220 is formed so that the gap C is greater than the width B (FIG. 3B) of the lower portion of the contact receiving hole 211.

As shown in FIG. 3B, when the U-shaped spring contacts 220 is inserted into the contact receiving hole 211 formed in the insulator 20, the second bending portion 225 and the other end 223 are compressed and tightly held in the lower portion of the contact receiving hole 211 because the gap C of the contact 220 is greater than the width B of the lower portion of the contact receiving hole 211. At this time, the second contact region 222 of the U-shaped spring contact 220 is displaced from a position P (FIG. 3A) on the upper surface of the printed circuit board 90 to a position Q (FIG. 3B) slightly shifted leftwards. It is noted here that the position P is offset leftward from a position R where a perpendicular line from the round contact projection 221 of the U-shaped spring contact 220 intersects the upper surface of the printed circuit board 90.

Referring to FIG. 3C, each of the U-shaped spring contacts 220 is compressed between the lower surface of an electronic component 100 and the upper surface of the printed circuit board 90 to be elastically deformed. Referring to FIG. 3D, electrical connection between the electronic component 100 and the printed circuit board 90 has been completed. During elastic deformation, the second contact region 222 of the U-shaped spring contact 220 is further displaced leftward along the upper surface of the printed circuit board 90 from the position Q to a position S (FIG. 3C) slightly offset leftward and finally to a position T slightly offset leftward again.

In the first existing electrical connector, the round contact projection formed at the bending top of the spring contact is greatly displaced in the direction perpendicular to the connecting direction. Therefore, when the contact pad of the electronic part is small, the round contact projection of the spring contact may possibly be failed to touch the contact pad of the electronic part.

In the second existing electrical connector, the radius of curvature of the bending top of the spring contact is greater than that of the first existing electrical connector so that the displacement in the direction perpendicular to the connecting direction is small. However, the contact force between the round contact projection of the spring contact and the contact pad of the electronic part per unit area is weak.

In the third existing electrical connector, the first and the second bending portions are present between the first and the second contact regions of the spring contact. Consequently, the inductance of the connector is great.

SUMMARY OF THE INVENTION

It is therefore an object of this invention to provide an electrical connector which is capable of preventing a contact region of a spring contact from being greatly displaced in a direction perpendicular to a connecting direction.

It is another object of this invention to provide an electrical connector which assures great contact force between contact regions of a spring contact and an electronic part per unit area.

It is still another object of this invention to provide an electrical connector which has a small inductance.

Other objects of this invention will become clear as the description proceeds.

According to an aspect of this invention, there is provided an electrical connector comprising a spring contact having a bending top providing a contact region to be brought into contact with a pad of an external electronic part, and an insulator supporting the spring contact, wherein the contact is provided with a pair of contact projections symmetrically formed on the bending top of the contact, the contact projections being arranged so that, when the electronic part approaches perpendicularly to the surface of the insulator, one of the contact projections at first touches the pad of the electronic part and the other of the contact projections finally touches the pad of the electronic part after the spring contact is elastically deformed by the electronic part.

DESCRIPTION OF THE PREFERRED EMBODIMENT

Referring to FIGS. 4 through 11, description will now be made about several preferred embodiments of this invention.

Figure 1:
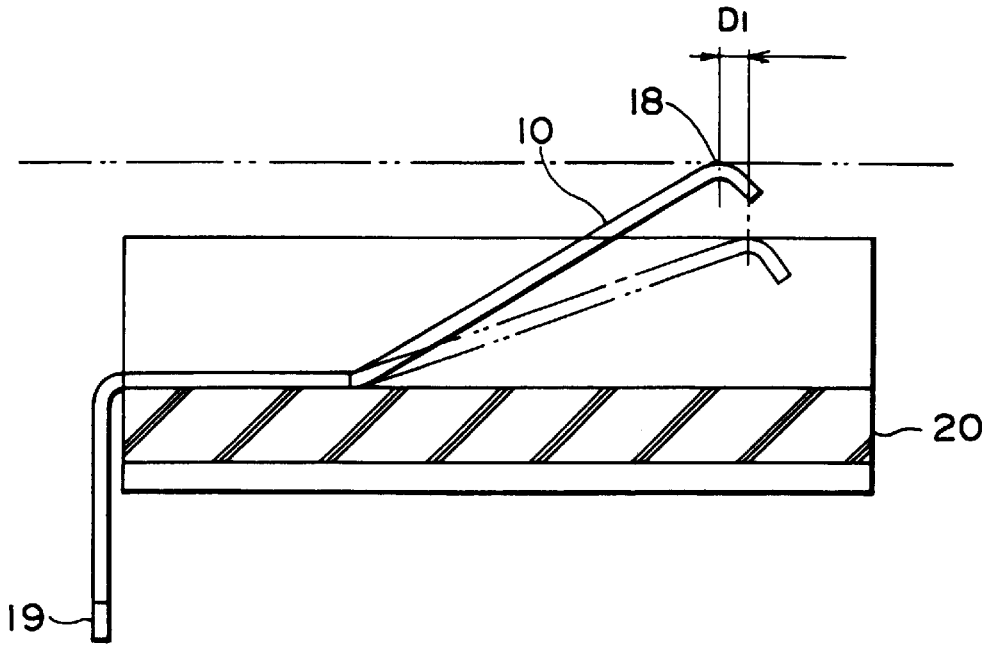
FIG. 1 PRIOR ART
FIG. 1 is a sectional view of a first existing electrical connector.
Figure 2:
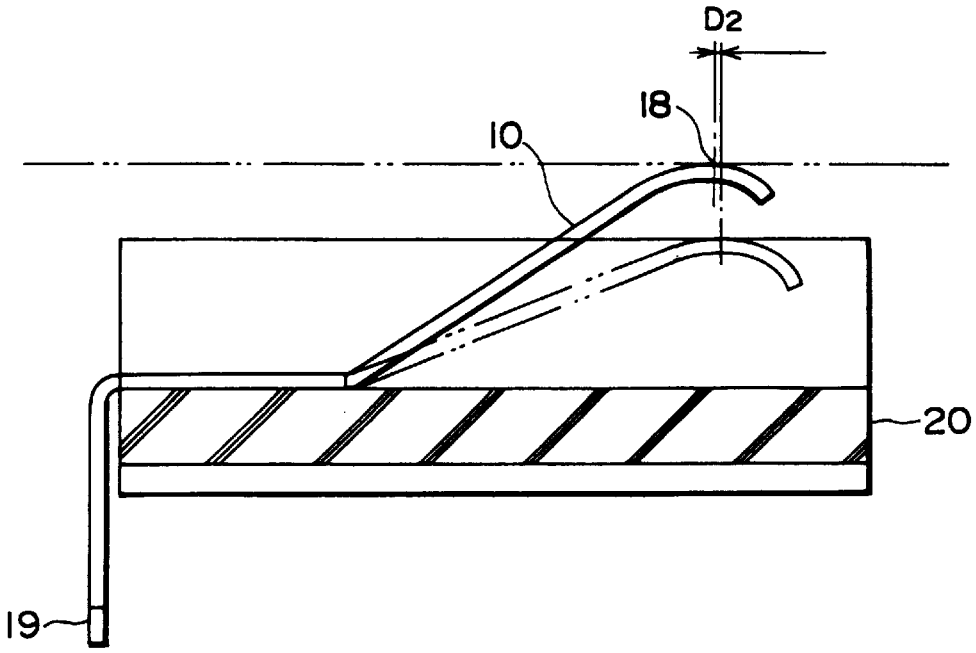
FIG. 2 PRIOR ART
FIG. 2 is a sectional view of a second existing electrical connector.
Figure 3B:
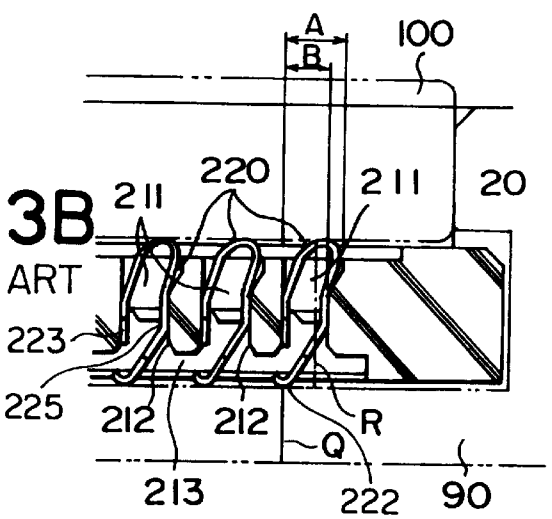
FIG. 3B PRIOR ART
FIGS. 3A through 3D are sectional views for describing an assembling and connecting process of a third existing electrical connector.
Figure 3D:
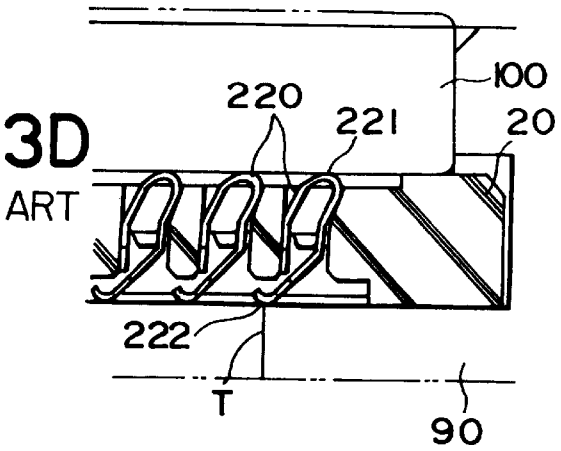
FIG. 3D PRIOR ART
Figure 3A:
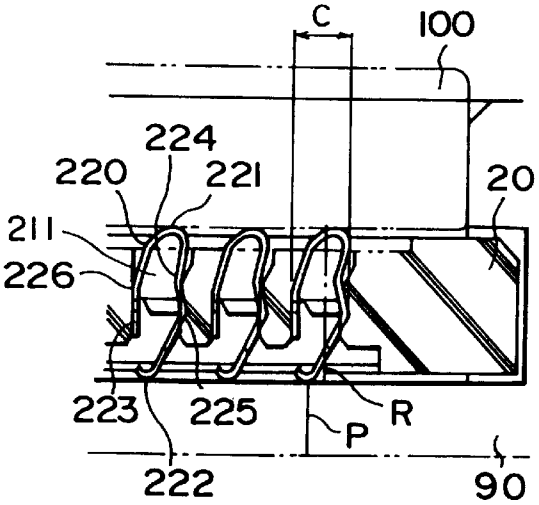
FIG. 3A PRIOR ART
Figure 3C:
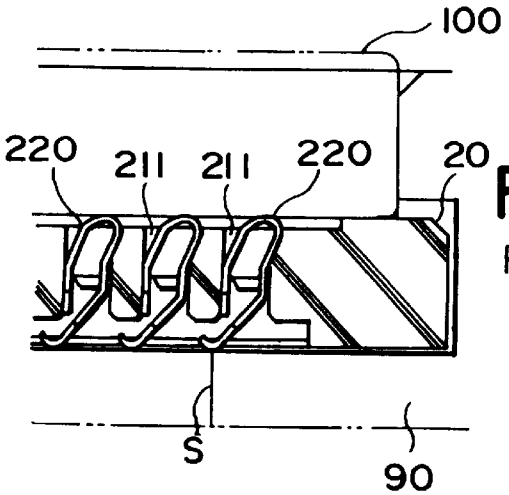
FIG. 3C PRIOR ART
Figure 4:
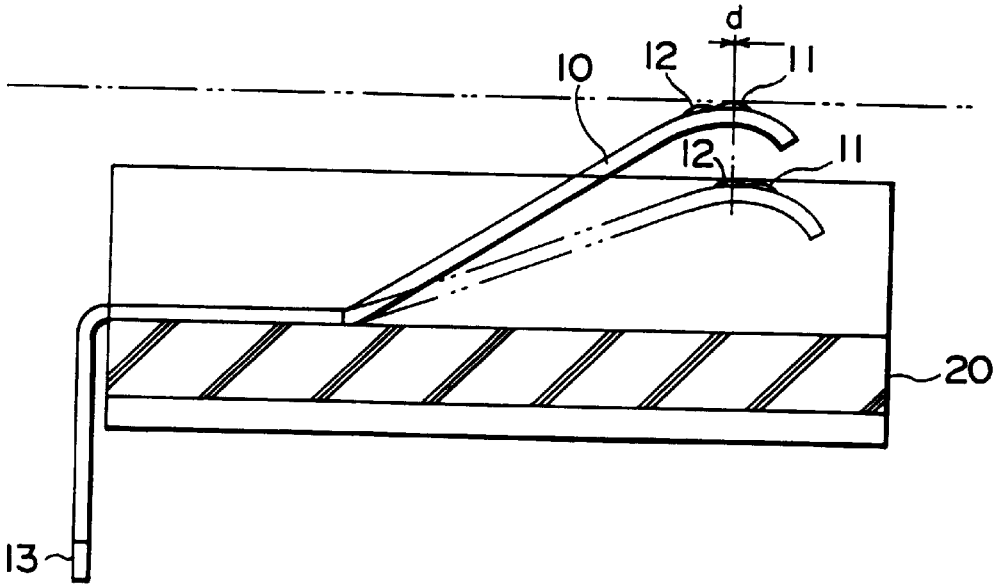
FIG. 4 is a sectional view of an electrical connector according to a first embodiment of this invention.

At first referring to FIG. 4, an electrical connector according to a first embodiment of this invention has a spring contact 10 with, as a pair of first contact regions, round contact projections 11 and 12 which are symmetrically formed at both sides of a peak of a bending top of the spring contact 10. The round contact projections 11 and 12 are formed on the surface of the spring contact 10 as dowels (protrusions) by means of soldering. The spring contact 10 is fixed to an insulator 20 at a central portion thereof and has a second contact region 13 at its lower end on the left side. The spring contact 10 is located at an initial position depicted by a solid line in a natural condition where no external force is applied. In this condition, the round contact projection 11 is located at a position remotest from the surface of the insulator 20, that is, a position on a two-dot chain line extending in parallel to the surface of the insulator 20.

When an electronic part (not shown) is made to approach the surface of the insulator 20 in a connecting direction perpendicular thereto, one of the round contact projections 11 at first touches a contact pad of the electronic part. Then, the spring contact 10 is elastically deformed by the electronic part to move to a deformed position depicted by a two-dot chain line. Finally, the other one of the round contact projections 12 touches the contact pad of the electronic part.

Following the above-mentioned movement of the spring contact 10 from the initial position (solid line) to the deformed position (two-dot chain line), the contact pad of the electronic part is brought into contact with, at first, one of the round contact projections 11 and finally the other one of the round contact projections 12. Herein, the contact position of the pad with each of the round contact projections 11 and 12 is substantially same. Therefore, the wiping amount "d" is extremely smaller than the wiping amounts D1 and D2 in the first and the second existing electrical connectors.

Figure 5:
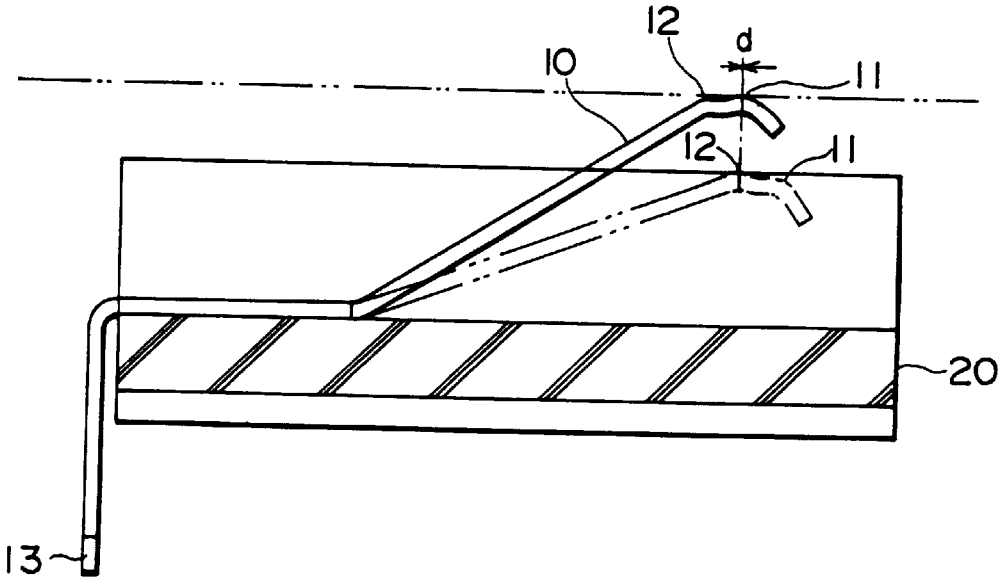
FIG. 5 is a sectional view of an electrical connector according to a second embodiment of this invention.

Next referring to FIG. 5, a second embodiment is similar in structure to the first embodiment except that a pair of contact projections 11 and 12 are formed by bending operation of the bending top of the spring contact 10. That is, the spring contact 10 has formed into reversed "W"-shape at the bending top and therefore, has two peaks at symmetrical position. The operation is similar to that described in conjunction with the first embodiment and will not be described any longer.

Referring to FIGS. 6A through 11, a third embodiment of this invention will be described.

Figure 6A:
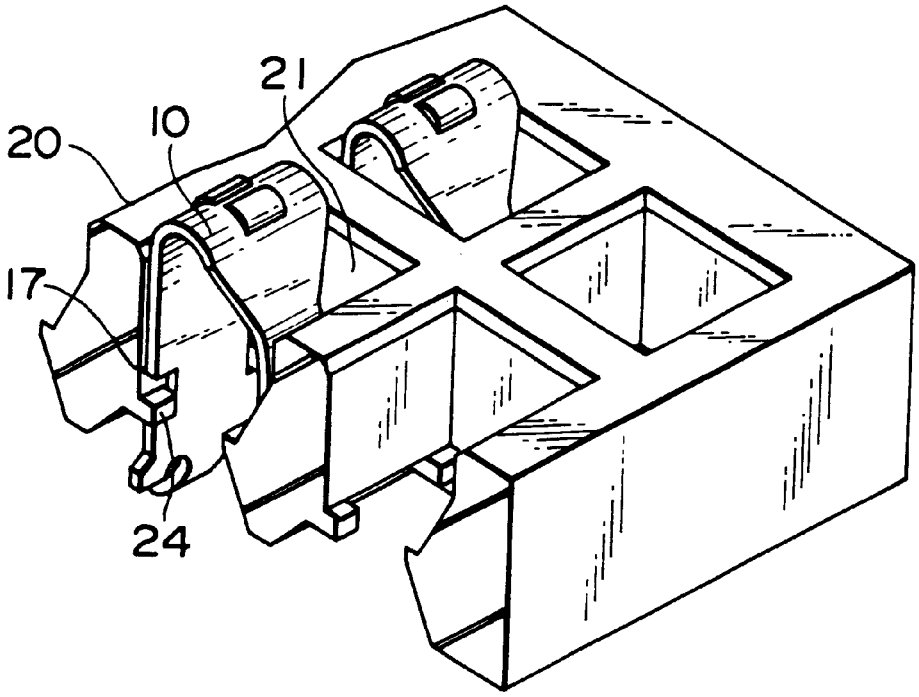
FIG. 6A is a perspective view of an electrical connector according to a third embodiment of this invention, showing the connector in a disconnected state.
Figure 7:
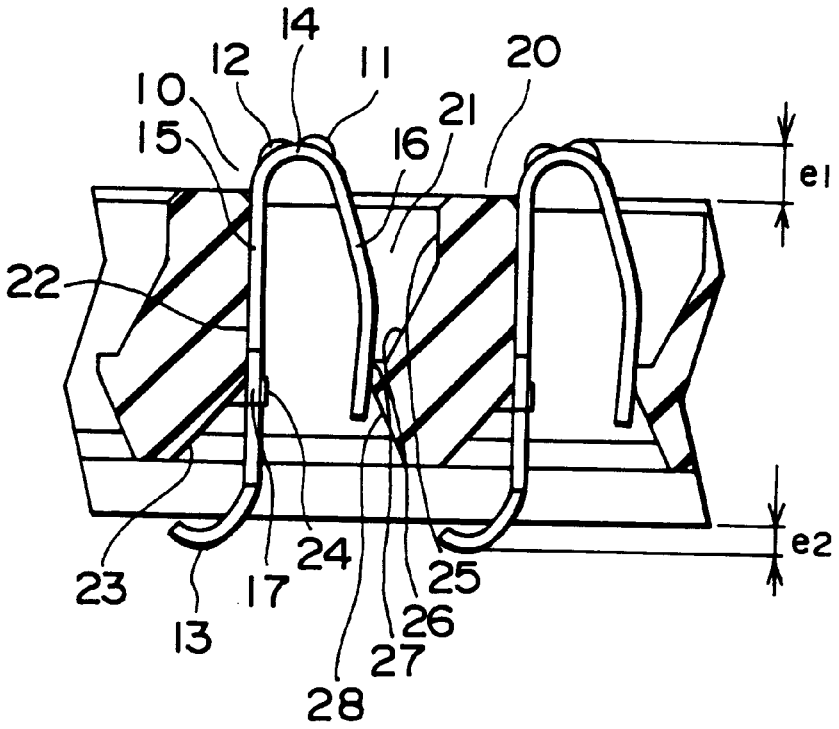
FIG. 7 is a sectional view of the electrical connector illustrated in FIG. 6A.

At first referring to FIGS. 6A and 7, a plurality of U-shaped spring contacts 10 are accommodated in a plurality of contact receiving holes 21 formed in an insulator 20, respectively. In the state illustrated in the figures, no external force is applied.

Each of the U-shaped spring contacts 10 is formed from a metallic plate which is shaped into a generally U shape by punching and bending.

Figure 6B:
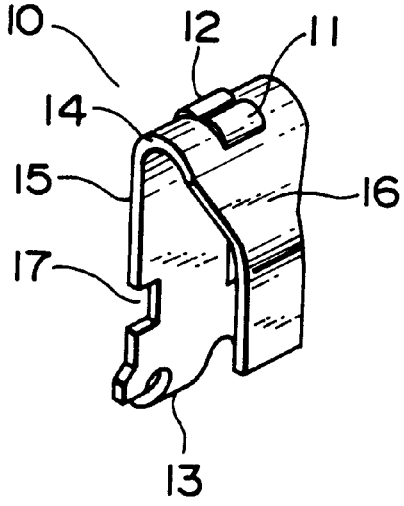
FIG. 6B is a perspective view of a U-shaped spring contact of the electrical connector illustrated in FIG. 6A.

As shown FIG. 6B, the U-shaped spring contact 10 has a bent portion 14, a pair of round contact projections 11 and 12 symmetrically formed at both sides of the peak of the bent portion 14, a generally flat portion 15 extending from one end of the bent portion 14, a second contact region 13 formed at an extending end of the generally flat portion 15, a spring portion 16 extending from the other end of the bent portion 14, and a pair of engaging portions 17 as notches formed on both sides of the generally flat portion 15.

Referring to FIG. 7, the contact receiving hole 21 formed in the insulator 20 is a through-hole having a rectangular section and extending perpendicular to the surface of the insulator 20. One inner wall of the contact receiving hole 21 has a vertical surface 22, an inclined surface 23 connected to the vertical surface 22, and a pair of projections 24 formed at both sides of a junction between the vertical surface 22 and the inclined surface 23. The other inner wall of the contact receiving hole 21 opposite to the one inner wall has a vertical surface 25, an inclined surface 26 connected to the vertical surface 25, a projection 27 connected to the inclined surface 26, and an inclined surface 28 connected to the projection 27. In the condition where no external force is applied, the U-shaped spring contact 10 is held by the projections 24 engaged with the engaging portions 17, the vertical surface 22, and the projection 27. The internal structure of the contact receiving hole 21 is formed so that the U-shaped spring contact 10 can be rotated and displaced from a position where no external force is applied (depicted by a two-dot chain line in FIG. 8) to a position where each of the round contact projection 12 and the second contact region 13 is connected (depicted by a solid line in FIG. 8).

Figure 8:
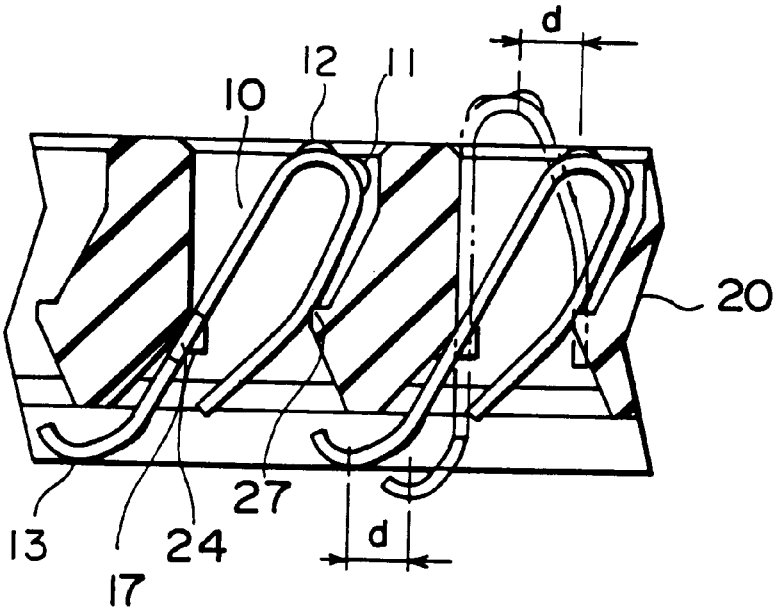
FIG. 8 is a view similar to FIG. 7 except that the connector is in a connected state.

Referring to FIG. 8, when an electronic part (a land grid array (LGA) package 100 which will later be described in conjunction with FIG. 11) is made to perpendicularly approach the surface of the insulator 20, a contact pad or land of the electronic part at first touches one of the round contact projection 11 of the U-shaped spring contact 10 located at the position depicted by a two-dot chain line. Then, the U-shaped spring contact 10 is elastically deformed to be displaced to the position shown by a solid line. Finally, the contact pad of the electronic part touches the other one of the round contact projections 12 of the U-shaped spring contact 10.

At this time, the contact pad of the electronic part contacts the round contact projections 11 and 12 of the spring contact 10 at different positions on the lower surface of the electronic part. The distance between the different positions is represented by a displacement d in a direction perpendicular to the connecting direction, i.e., the wiping amount of the spring contact 10. The displacement d is smaller than the displacement e1+e2 of the U-shaped spring contact 10 in the connecting direction.

Figure 9:
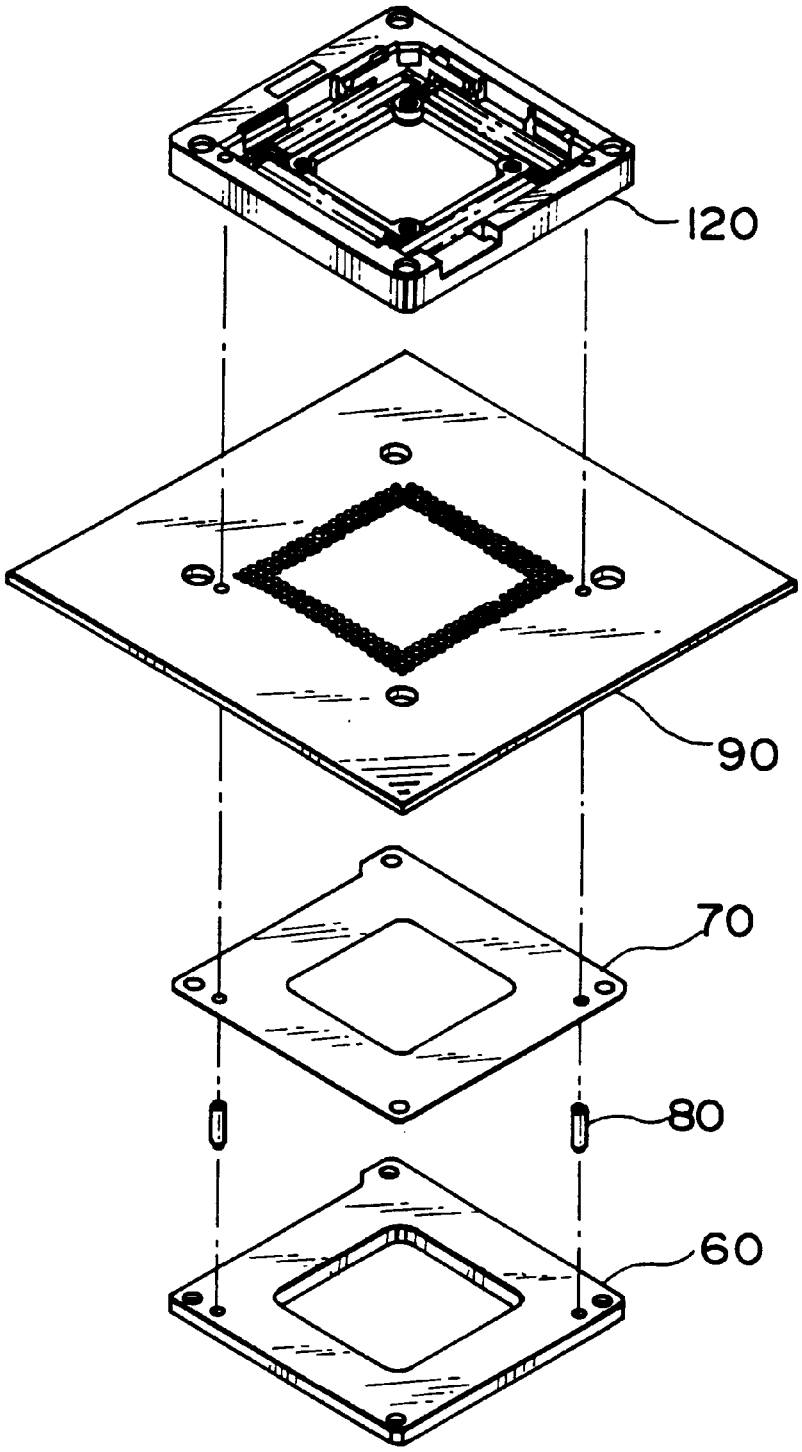
FIG. 9 is an exploded perspective view of an electrical apparatus equipped with the electrical connector according to the third embodiment of this invention, before a cover is assembled thereto.
Figure 10:
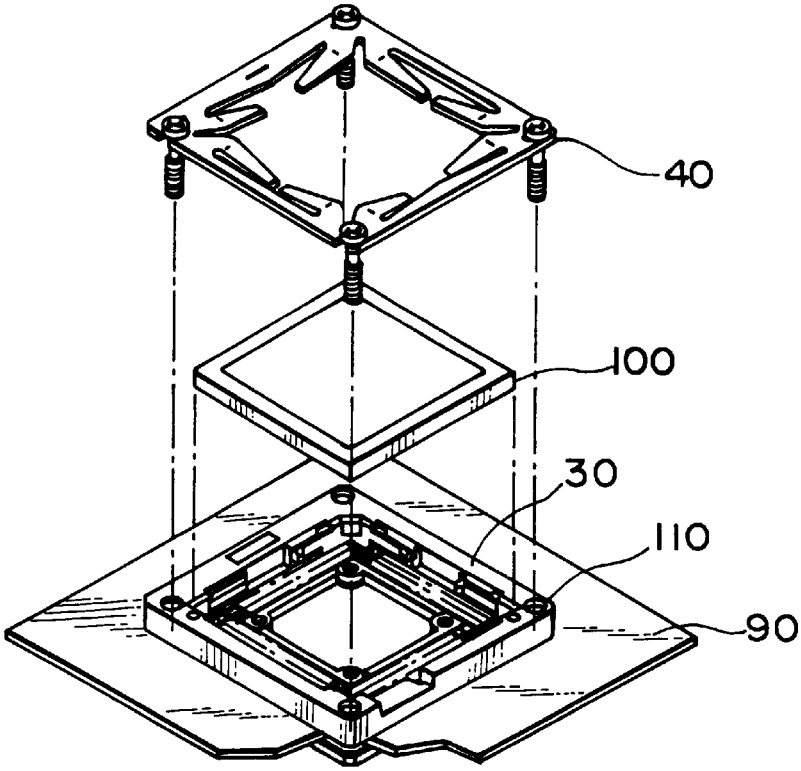
FIG. 10 is an exploded perspective view of the electrical apparatus illustrated in FIG. 9 with the cover assembled thereto.
Figure 11:
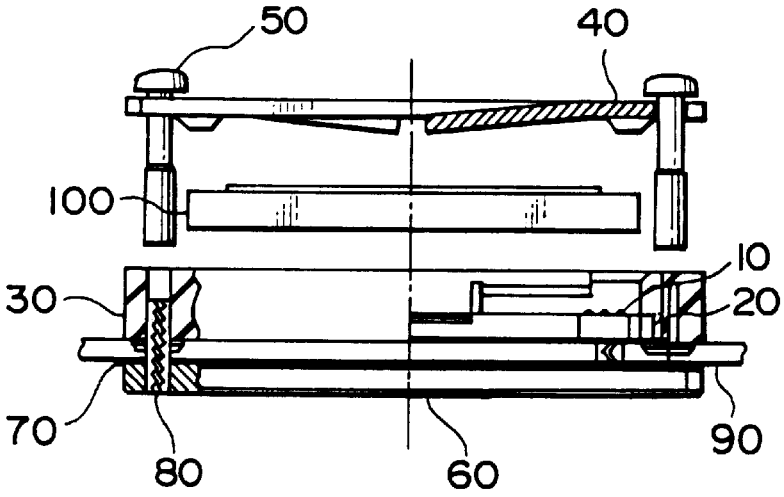
FIG. 11 is a sectional view of the electrical apparatus illustrated in FIG. 10 during assembling.

Turning to FIGS. 9 through 11, an electronic apparatus equipped with the electrical connector according to the third embodiment of this invention will be described.

The electronic apparatus comprises a back plate 60, an insulator film 70, a printed circuit board 90, a frame 30, a land grid array (LGA) package 100, and a cover 40 successively stacked in this order. The frame 30 accommodates the insulator 20 with a number of the U-shaped spring contacts 10 supported thereon. The back plate 60, the insulated film 70, the printed circuit board 90, and the frame 30 are fixed together by the use of two press-fit pins 80. The cover 40 is fixed to the frame 30 by means of four screw bolts 50. A combination of the printed circuit board 90, the frame 30, the insulator 20, and the U-shaped spring contacts 10 is called a board assembly 110. A combination of the frame 30, the insulator 20, and the U-shaped spring contacts 10 is called a frame assembly 120.

As will be understood from the foregoing description, this invention has the following effects.

1. It is possible to reduce the displacement of the contact region of the contact in the direction perpendicular to the connecting direction. Therefore, in case where the contacts of the electrical connector are arranged at a narrow pitch, the contact region of the spring contact reliably touches the contact pad of the electronic part even if the contact pad of the electronic part is small.
2. By reducing the curvature of the bending top of the spring contact, the contact force between the contact region of the spring contact and the contact pad of the electronic part per unit area can be increased.
3. Even if the U-shaped spring contact is small, the contact force between the contact region of the U-shaped spring contact and the contact pad of the electronic part can be increased because the displacement of the U-shaped spring contact in the direction of compression force is large.
4. Since the portion between the first and the second contact regions of the U-shaped spring contact is flat and short, the inductance of the connector can be reduced.
5. Since the engaging portions formed in the U-shaped spring contact are engaged with the projections formed on the insulator, the U-shaped spring contact can be prevented from slipping out from the insulator.

What is claimed is:

1. An electrical connector comprising a spring contact having a bending top providing a contact region to be brought into contact with a pad of an external electronic part, and an insulator supporting said spring contact, wherein said contact is provided with a pair of contact projections symmetrically formed on said bending top of said contact, said contact projections being arranged so that, when said electronic part approaches perpendicularly to the surface of said insulator, one of said contact projections at first touches said pad of said electronic part and the other of said contact projections finally touches said pad of said electronic part after said spring contact is elastically deformed by making and completing contact with said electronic part.

2. An electrical connector as claimed in claim 1, wherein both of said contact projections are formed as protrusions by means of a press bending operation.

3. An electrical connector as claimed in claim 1, wherein both of said contact projections are formed as round protrusions by means of soldering.

4. An electrical connector as claimed in claim 1, wherein said spring contact is formed generally in a U-shape and has a bent portion at said bending top, a generally flat portion extending from one end of said bent portion, a second contact region formed at an extending end of said generally flat portion, and a spring portion extending from the other end of said bent portion, said insulator having a contact receiving hole into which said spring contact is inserted, said contact receiving hole having a contact holding portion and a rotation allowable portion to allow the rotation of said spring contact.

5. An electrical connector as claimed in claim 4, wherein said contact has a pair of engaging portions formed in said generally flat portion and a pair of projections formed on said insulator so that said spring contact is prevented from slipping out from said insulator and is rotatably supported.

6. An electrical connector as claimed in claim 4 or 5, wherein a plurality of said spring contacts and a plurality of said contact receiving holes are arranged in the lengthwise and crosswise directions thereof.

* * * * *